US008807972B2

(12) United States Patent
Reighard et al.

(10) Patent No.: US 8,807,972 B2
(45) Date of Patent: Aug. 19, 2014

(54) HOUSINGLESS POSITIVE DISPLACEMENT PUMP ASSEMBLY

(75) Inventors: Michael A. Reighard, Avon Lake, OH (US); Daniel T. DePauw, Strongsville, OH (US); David A. Sedlak, Brunswick, OH (US)

(73) Assignee: Hydro-Aire Inc., Elyria, OH (US)

( * ) Notice: Subject to any disclaimer, the term of this patent is extended or adjusted under 35 U.S.C. 154(b) by 430 days.

(21) Appl. No.: 13/088,010

(22) Filed: Apr. 15, 2011

(65) Prior Publication Data

US 2012/0263614 A1 Oct. 18, 2012

(51) Int. Cl.

| | |
|---|---|
| ***F01C 1/30*** | (2006.01) |
| ***F03C 2/00*** | (2006.01) |
| ***F03C 4/00*** | (2006.01) |
| ***F04C 2/00*** | (2006.01) |
| ***F04C 11/00*** | (2006.01) |
| ***F01C 21/00*** | (2006.01) |
| *F04C 2/344* | (2006.01) |
| *F04C 2/10* | (2006.01) |

(52) U.S. Cl.

CPC ..... *F04C 11/001* (2013.01); *F04C 2/344* (2013.01); *F04C 2240/805* (2013.01); *F04C 2230/60* (2013.01); *F04C 2/10* (2013.01); *F01C 21/007* (2013.01)

USPC ..... 418/3; 418/70; 418/166; 418/171; 418/212; 418/259

(58) Field of Classification Search

USPC ..... 418/3, 70, 212–213, 166, 171, 259

See application file for complete search history.

(56) References Cited

U.S. PATENT DOCUMENTS

| | | | | |
|---|---|---|---|---|
| 3,354,978 | A * | 11/1967 | Budzich | 180/243 |
| 3,399,826 | A | 9/1968 | Andriulis | |
| 3,901,631 | A * | 8/1975 | Wickham et al. | 418/70 |
| 4,201,521 | A | 5/1980 | Carlson | |
| 4,415,319 | A * | 11/1983 | Masuda et al. | 418/212 |
| 4,528,861 | A | 7/1985 | Stubbs | |
| 4,619,594 | A | 10/1986 | Moir | |
| 4,838,772 | A | 6/1989 | LeBlanc | |
| 5,037,283 | A | 8/1991 | Kapur et al. | |
| 5,588,821 | A * | 12/1996 | Kinoshita | 418/259 |
| 5,839,889 | A * | 11/1998 | Folsom et al. | 418/31 |
| 5,944,489 | A | 8/1999 | Vaughn et al. | |
| 6,499,964 | B2 | 12/2002 | Staton et al. | |
| 7,048,525 | B2 | 5/2006 | Brick et al. | |

* cited by examiner

*Primary Examiner* — Theresa Trieu

(74) *Attorney, Agent, or Firm* — Renner, Otto, Boisselle & Sklar, LLP

(57) ABSTRACT

Housingless positive displacement pump assembly comprises one or more vane or gerotor type housingless positive displacement pump units, each comprising pump unit components. One or more retaining rods extend through axially aligned holes in a mounting flange at one end of the pump assembly and the pump unit components to hold the pump unit components in stacked relation to one another and connect the pump assembly to the mounting flange.

19 Claims, 2 Drawing Sheets

HOUSINGLESS POSITIVE DISPLACEMENT PUMP ASSEMBLY

FIELD OF THE INVENTION

This invention relates generally to a housingless positive displacement pump assembly that is directly insertable as a line replaceable unit into a bore in the housing of an aircraft or other application component such as a generator, gearbox, engine or other application component or system.

BACKGROUND OF THE INVENTION

Many aerospace and other pump applications require a vane or gerotor type positive displacement cartridge style pump to be installed in the housing of an application component such as a generator, gearbox, engine or other application component or system for moving oil, fuel, coolant or other fluid through the component or system. Existing cartridge pumps have an integral pump housing that contains all of the pump elements and drive components. Gaps or clearances between components and housings result in a reduction of the pump volumetric efficiency as leakage will occur from higher pressure to lower pressure areas of the pump and system. The two main considerations for leakage are from the discharge to the inlet of each pumping element and from one pumping element to another pumping element when multiple elements exist within one pump. Critical clearances that directly affect the pump volumetric efficiency are the clearance between the pump housing outer diameter and application housing (generator, gearbox, etc.), and the pump housing inner diameter and pumping components.

SUMMARY OF THE INVENTION

The housingless positive displacement pump assembly of the present invention is a self-contained line replaceable unit that does not require a pump housing to retain the pump components in assembled relation. This allows the pump assembly to be inserted directly into a bore in the housing of an application component such as a generator, gearbox, engine or other application component, thereby eliminating the cost and weight of the pump housing, and improving efficiency by reducing the number of leakage paths.

More particularly, the housingless positive displacement pump assembly comprises one or more vane or gerotor type housingless positive displacement pump units. One or more retaining rods extend through axially aligned holes in a mounting flange at one end of the pump assembly and the pump unit components of one or more pump units to hold the pump unit components in stacked relation to one another and connect the pump assembly to the mounting flange. The application component housing bore provides final alignment of the pump unit components when the pump assembly is inserted into the bore as a line replaceable unit. The one or more retaining rods are spring loaded to provide a preload force on the pump unit components to maintain a controlled fit of the assembly prior to installation in the application component housing bore.

To the accomplishment of the foregoing and related ends, the invention, then, comprises the features hereinafter more fully described and particularly pointed out in the claims, the following description and the annexed drawings setting forth in detail a certain illustrative embodiment of the invention, this being indicative, however, of but several of the various ways in which the principles of the invention may be employed.

DETAILED DESCRIPTION OF THE INVENTION

Figure 1:
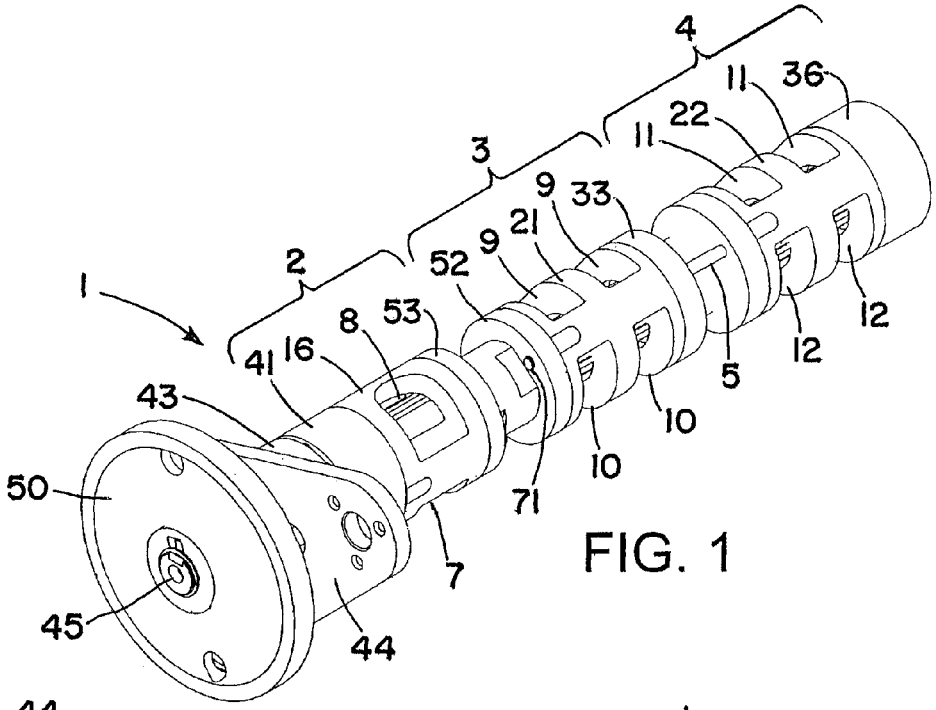
FIG. 1 is an isometric view of one form of housingless positive displacement pump assembly of the present invention.

Referring now in detail to the drawings, and initially to FIG. 1, there is shown one form of housingless positive displacement pump assembly 1 of the present invention which may include one or more vane type and/or gerotor type positive displacement pump units 2, 3 and 4 (hereafter referred to as pump units). A vane type pump unit generally comprises the following pump unit components: rotor, liner, vanes and bearings. A gerotor or internal gear type pump unit generally comprises the following pump unit components: internal gear, external gear, eccentric ring, port plates, bearings and shaft. The number and type of pump units may vary depending on the particular application.

The particular embodiment shown in FIG. 1 includes three pump units 2, 3 and 4. By way of example, pump unit 2 is a vane type lube pump unit for drawing oil directly from an oil reservoir for distribution to various application components or systems for lubrication, whereas pump units 3 and 4 are scavenge pump units for drawing air and oil from gearboxes or other areas of application components or systems for discharge to an oil separator and return back to the oil reservoir for recirculation by the lube pump unit. Some applications may only require one pump unit. Others may require two or more pump units. The housingless pump assembly of the present invention may accommodate one or more such pump units.

Pump assembly 1 is a housingless self-contained line replaceable unit that uses one or more retaining rods to hold the various pump unit components in stacked relation to one another and connect one end of the pump assembly to a mounting flange. Eliminating the pump housing enables the pump assembly 1 to be inserted as a unit directly into an appropriately sized bore in the housing of an application component or system such as a generator, gearbox, engine or other application component or system as described hereafter. This reduces the overall weight and cost of the pump assembly and also eliminates one potential leakage path between the pump housing and application component housing.

The number of retaining rods used to hold the various pump unit components together and connect one end of the pump assembly to the mounting flange may vary depending on the specific application. In some applications, only one retaining rod may be required. In other applications, two or more retaining rods may be required.

In the exemplary embodiment disclosed herein, two retaining rods 5 and 6 are used because the inlet and discharge ports 7 and 8 for the pump unit 2 and the respective inlet and discharge ports 9, 10 and 11, 12 for the pump units 3 and 4 are at different angles. Thus the axial hole 15 in the liner 16 surrounding the rotor 17 of the lube pump unit 2 that receives retaining rod 6 is at a different angular location than the axial holes 19 and 20 in the liners 21 and 22 surrounding the rotors 23 and 24 of the pump units 3 and 4 that receive the retaining rod 5 (see FIGS. 2 and 3).

Figure 2:
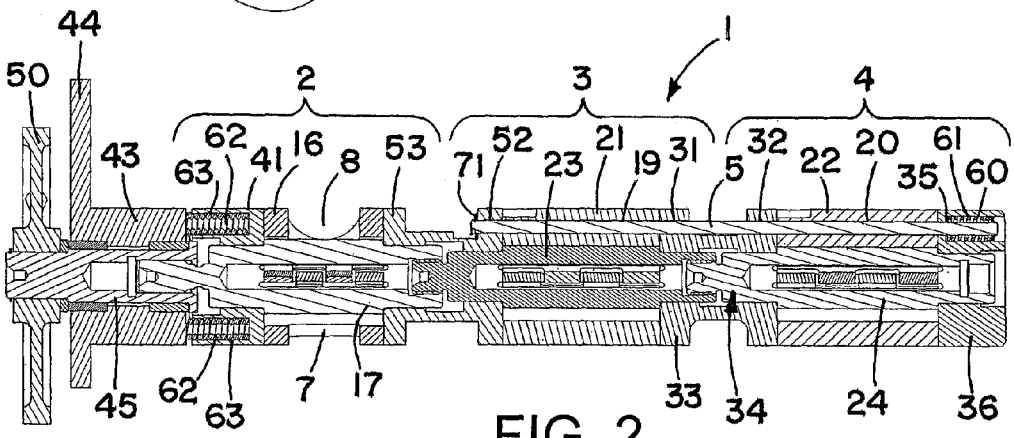
FIG. 2 is a longitudinal section through the pump assembly of FIG. 1 taken through one retaining rod that is shown extending through axially aligned holes in various component parts of two associated pump units to hold the two pump units in substantially axially stacked relation to one another.
Figure 3:
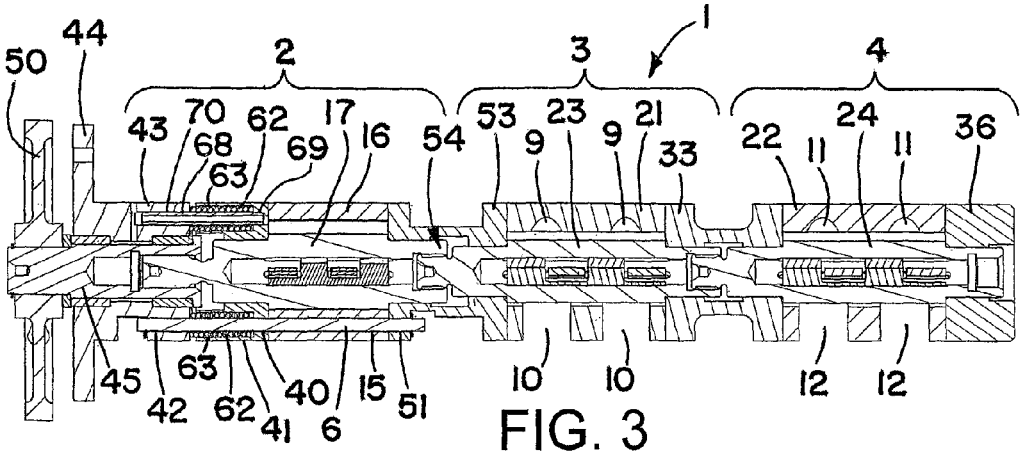
FIG. 3 is a longitudinal section through the pump assembly of FIG. 1 taken through another retaining rod that is shown extending through axially aligned holes in the hub portion of a mounting flange and the various component parts of an adjacent pump unit and one of the other pump units to maintain the pump units in substantially axially stacked relation to one another and connect all of the pump units to the mounting flange.

FIG. 2 shows retaining rod 5 extending through the axially aligned holes 19 and 20 in the liners 21 and 22, holes 31 and 32 in bearing 33 surrounding the coupling portion 34 of rotor 24 between the pump units 3 and 4 and hole 35 in anti-drive bearing 36 at the outboard end of the outermost pump unit 4, whereas FIG. 3 shows retaining rod 6 extending through hole 15 in the liner 16, hole 40 in bearing retainer 41 at the inboard end of the pump unit 2 and hole 42 in hub portion 43 of exterior mounting flange 44 exterior of one end of the pump assembly 1 that is journal mounted on a drive shaft 45 coupled to the rotor 17. The pump assembly is connected to the exterior mounting flange 44 via a connection between an end of the retaining rod 6 and the exterior mounting flange. Also the pump units 3 and 4 and pump unit 2 are held together in stacked relation by the respective retaining rods 5 and 6 extending through holes 51 and 52 in bearing 53 surrounding the coupling portion 54 of rotor 23 between the rotor 17 and adjacent rotor 23 as further shown in FIGS. 2 and 3. Pump assembly 1 can be driven directly through a splined coupling or gear 50 attached to the pump drive shaft 45.

A spring 60 located within a counterbore 61 in the anti-drive bearing 36 surrounds the outboard end of retaining rod 5 (see FIG. 2). Additional stack springs 62 are located in circumferentially spaced counterbores 63 in the inboard end bearing retainer 41 for pressing engagement against the adjacent end of the mounting flange hub portion 43. One stack spring 62 is shown in FIG. 3 surrounding retaining rod 6 whereas another stack spring 62 is shown surrounding a tube 68 extending into aligned openings 69 and 70 in the inboard end bearing retainer 41 and mounting flange hub portion 43. Other circumferentially spaced counterbores 63 in bearing retainer 41 contain other stack springs 62 as shown in FIG. 2. During assembly, the stack springs 62 are compressed slightly and retaining pins or clips 71 (see FIGS. 1 and 2) are installed on the ends of the retaining rods to retain the various pump unit components on the retaining rods and hold the pump assembly together as a self-contained line replaceable unit that does not require a housing to retain the pump unit components.

Figure 4:
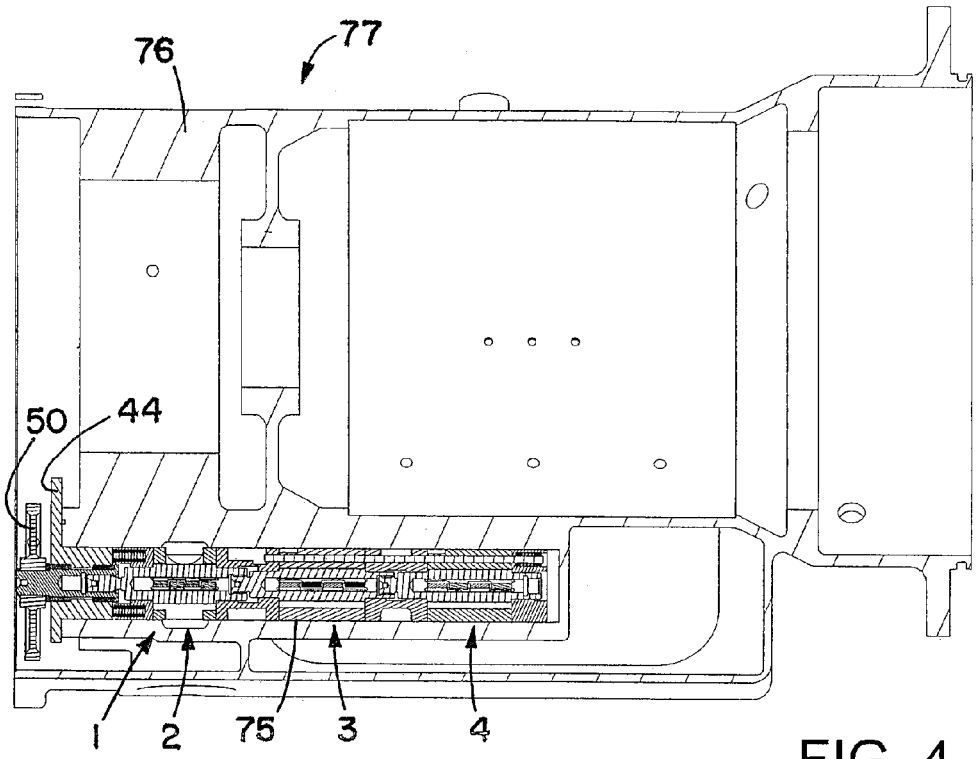
FIG. 4 is a schematic longitudinal section through an application component housing having a bore sized for close sliding receipt of the housingless pump assembly of FIG. 1 into the bore as a line replaceable unit.

The spring-loaded rods 5 and 6 and pump rotors 17, 23 and 24 containing associated pump elements retain the pump units in stacked relation to one another. However, the pump units can move slightly relative to one another. Final axial alignment of the pump units is provided by installing the entire pump assembly 1 except for mounting flange 44 into a bore 75 in the housing 76 of an application component such as a gearbox, generator, engine or other application component or system 77 as shown in FIG. 4. The hub portion 43 of mounting flange 44, bearings 33, 36, 41, 53 and liners 16, 21 and 22 all have corresponding outer diameters.

Figure 5:
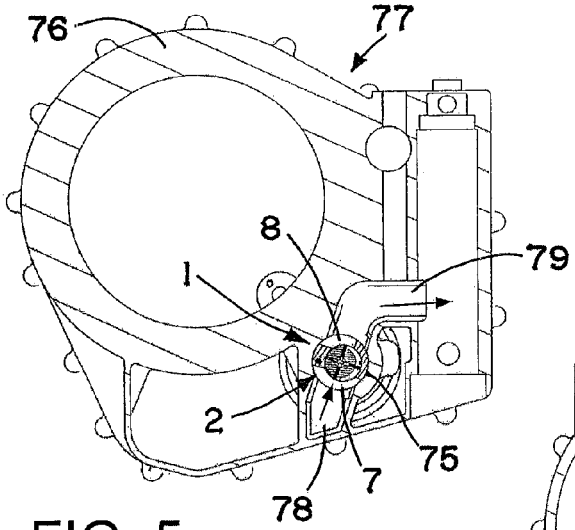
FIG. 5 is a transverse section through the application component housing and pump assembly of FIG. 4 showing lube inlet and discharge passages in the housing in fluid communication with lube inlet and discharge ports of the lube pump unit.
Figure 6:
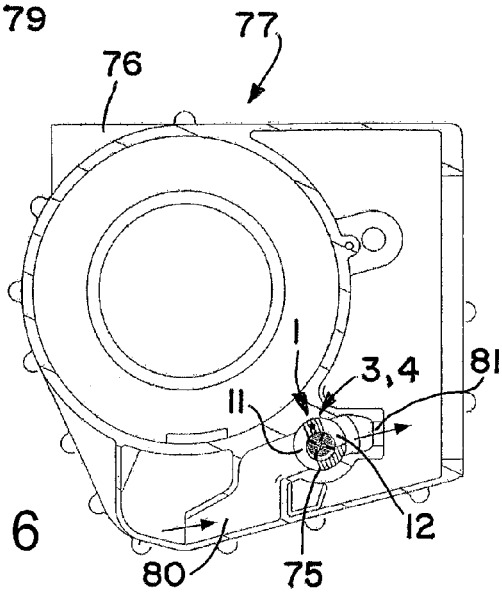
FIG. 6 is a transverse section through the application component housing and pump assembly similar to FIG. 5 but showing scavenge inlet and discharge passages in the housing in fluid communication with scavenge inlet and discharge ports of the scavenge pump units.

The bore 75 in the application component housing 76 is sized for close sliding receipt of the pump assembly 1 within the bore to provide the desired clearance seal between the pump units 2, 3 and 4 as shown in FIG. 4 as well as between the inlet and discharge ports 7 and 8 of the pump unit 2 as shown in FIG. 5 and the inlet and discharge ports 11 and 12 of the pump units 3 and 4 as shown in FIG. 6. FIG. 5 also shows the inlet and discharge passages 78 and 79 in the application component housing 76 communicating with the pump inlet and discharge ports 7 and 8, whereas FIG. 6 shows the inlet and discharge passages 80 and 81 in the application component housing 76 communicating with the respective inlet and discharge ports 9, 10 and 11, 12 of the pump units 3 and 4. When the pump exterior mounting flange 44 is bolted or otherwise secured to the exterior surface of the application component housing 76, the stack springs 62 are compressed to a controlled height to provide a desired preload on the various pump unit components to maintain proper compression of the pump units under operating pressure to prevent component separation.

From the foregoing, it will now be apparent that by making the housingless pump assembly of the present invention a self-contained line replaceable unit without a housing provides for improved pump efficiency by reducing the number of leakage paths. Also eliminating the housing reduces the overall size and weight of the pump assembly and provides for reduced pump complexity.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms used to describe such components are intended to correspond, unless otherwise indicated, to any component which performs the specified function of the described component (e.g., that is functionally equivalent), even though not structurally equivalent to the disclosed component which performs the function of the herein disclosed exemplary embodiment of the invention. In addition, while a particular feature of the invention may have been disclosed with respect to only one embodiment, such feature may be combined with one or more other features as may be desired and advantageous for any given or particular application.

What is claimed is:

1. A housingless positive displacement pump assembly comprising one or more vane or gerotor type housingless positive displacement pump units, the one or more pump units each comprising pump unit components, an exterior mounting flange exterior of one end of the pump assembly, and at least one retaining rod extending through axially aligned holes in the exterior mounting flange and the pump unit components to hold the pump unit components in stacked relation to one another and connect the pump assembly to the exterior mounting flange via a connection between an end of the retaining rod and the exterior mounting flange, wherein the at least one retaining rod comprises a single retaining rod that holds the pump unit components of a plurality of the pump units in stacked relation to one another and connects all of the pump units to the exterior mounting flange via the connection between the end of the single retaining rod and the exterior mounting flange.

2. The pump assembly of claim 1 wherein the one or more pump units are retained on the at least one retaining rod by retaining clips or pins on the ends of the at least one retaining rod.

3. The pump assembly of claim 1 wherein the pump units comprise one or more lube pump units or scavenge pump units.

4. The pump assembly of claim 1 installed in a bore in an application component housing with the exterior mounting flange attached to an exterior surface of the housing, the housing having respective passages communicating with inlet and discharge ports of the one or more pump units for pumping fluids through the passages.

5. The pump assembly of claim 4 wherein the application component is a gearbox, generator or engine or other application containing a fluid system.

6. The pump assembly of claim 4 wherein the bore is sized for close sliding receipt of the pump assembly and attachment of the exterior mounting flange to the exterior surface of the housing, the housing having inlet and discharge passages that communicate with the respective inlet and discharge ports of the one or more pump units.

7. The pump assembly of claim 6 wherein clearances are provided in the bore between the respective inlet and discharge ports of the one or more pump units and the inlet and discharge passages in the housing.

8. The pump assembly of claim 6 wherein the one or more of the pump units are retained on the at least one retaining rod by retaining clips or pins on the ends of the at least one retaining rod.

9. The pump assembly of claim 6 wherein the at least one retaining rod is spring loaded to provide a preload force on the pump unit components.

10. The pump assembly of claim 6 further comprising stack springs between the exterior mounting flange and the one end of the pump assembly that are compressed to a controlled height during insertion of the pump assembly into the bore and attachment of the exterior mounting flange to the exterior surface of the housing to provide a preload force on the pump unit components to maintain a fluid seal therebetween.

11. The pump assembly of claim 1 wherein an additional retaining rod holds the pump unit components of an additional pump unit in stacked relation and connects the additional pump unit to the one pump unit.

12. The pump assembly of claim 1 mounted in a bore in a housing of an application component or system for moving fluid through the application component or system, the bore in the housing of the application component or system being sized for close sliding receipt of the pump assembly and attachment of the exterior mounting flange to an exterior surface of the housing, the housing having inlet and discharge passages that communicate with respective inlet and discharge ports of the one or more pump units.

13. The pump assembly of claim 12 wherein clearances are provided in the bore between the respective inlet and discharge ports of the one or more pump units and the inlet and discharge passages in the housing.

14. The pump assembly of claim 12 wherein one or more of the pump units are retained on the one or more retaining rods by retaining clips or pins on the ends of the one or more retaining rods.

15. The pump assembly of claim 12 wherein at least one of the retaining rods is spring loaded to provide a preload force on the pump unit components.

16. The pump assembly of claim 12 further comprising stack springs between the exterior mounting flange and the one end of the pump assembly that are compressed to a controlled height during insertion of the pump assembly into the bore and attachment of the exterior mounting flange to the exterior surface of the housing to provide a preload force on the pump unit components to maintain a fluid seal therebetween.

17. The pump assembly of claim 1 wherein the exterior mounting flange comprises means for attaching the housingless positive displacement pump assembly to an exterior surface of an application component housing upon insertion of the housingless positive displacement pump assembly in a bore in the application component housing.

18. The pump assembly of claim 1 wherein an additional retaining rod holds the pump unit components of a plurality of additional pump units in stacked relation and connects the plurality of additional pump units to the one pump unit.

19. A housingless positive displacement pump assembly comprising one or more vane or gerotor type housingless positive displacement pump units, the one or more pump units each comprising pump unit components, an exterior mounting flange exterior of one end of the pump assembly, at least one retaining rod extending through axially aligned holes in the exterior mounting flange and the pump unit components to hold the pump unit components in stacked relation to one another and connect the pump assembly to the exterior mounting flange via a connection between an end of the retaining rod and the exterior mounting flange, and spring means for spring loading the at least one retaining rod to provide a preload force on the pump unit components to maintain a controlled fit of the pump assembly prior to installation in a bore in an application component housing.

* * * * *